United States Patent [19]

Mihara

[11] 3,965,846

[45] June 29, 1976

[54] ENDLESS BELT PROPULSION DEVICE FOR A HIGH SPEED BOAT

[75] Inventor: Osamu Mihara, Fujisawa, Japan

[73] Assignee: Asahi Kasei Kogyo Kabushiki Kaisha, Osaka, Japan

[22] Filed: June 7, 1974

[21] Appl. No.: 477,422

[52] U.S. Cl. ..... 115/64; 114/66.5 H; 416/8

[51] Int. Cl.[2] ..... B63H 1/34

[58] Field of Search ..... 114/66.5 R, 66.5 H, 114/61, 56; 115/63, 64; 415/5; 416/7, 8

[56] References Cited

UNITED STATES PATENTS

| | | | |
|---|---|---|---|
| 816,368 | 3/1906 | Pelissier | 115/63 |
| 1,422,542 | 7/1922 | Creed | 114/66.5 R |
| 1,565,170 | 12/1925 | Roy | 115/63 |
| 2,705,470 | 4/1955 | Baker et al. | 115/64 |
| 3,347,197 | 10/1967 | Scherer | 114/66.5 H |
| 3,683,840 | 8/1972 | Russell | 114/66.5 R |

FOREIGN PATENTS OR APPLICATIONS

| | | | |
|---|---|---|---|
| 509,497 | 9/1930 | Germany | 416/7 |

*Primary Examiner*—Trygve M. Blix
*Assistant Examiner*—Edward R. Kazenske
*Attorney, Agent, or Firm*—Armstrong, Nikaido & Wegner

[57] ABSTRACT

A special high-speed boat fixed with a propeller unit under a hull, is provided. The propeller unit includes a plurality of wheels which are arranged in a space provided in the propeller unit. An endless belt having a certain number of fixed thereto blades moves from one of the plurality of wheels to another, such that some of the blades extend outside of the propeller unit into water.

4 Claims, 7 Drawing Figures

ENDLESS BELT PROPULSION DEVICE FOR A HIGH SPEED BOAT

BACKGROUND OF THE INVENTION

The present invention relates to a completely novel, special high-speed boat attached with a propeller unit having an endless belt structure.

It is well known that today's most popular boats have a structure of long and narrow hull fitted with at least one screw propeller on its stern. Said structure has many drawbacks of related elements such as speed, wave drag, change of direction, braking and strength. As far as said structure of conventional boats is employed, there will be always unavoidable drawbacks of the above complicated elements.

SUMMARY OF THE INVENTION

The conventional drawbacks were overcome by the development of a unique hull structure and a unique propeller unit according to the present invention. The inventor has successively developed a special boat in which adjustment of rising is possible and which has a novel and useful propeller unit of high propulsion efficiency.

BRIEF DESCRIPTION OF THE DRAWING

Various embodiments of the present invention will now be described, by way of example only, with reference to the accompanying drawings, in which.

DETAILED DESCRIPTION OF THE INVENTION

Figure 1:
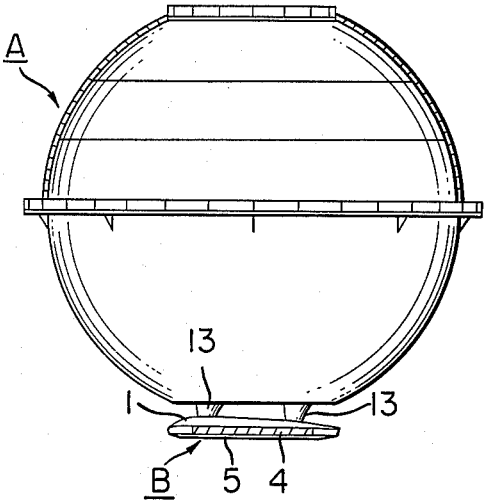
FIG. 1 is a side view of a special high-speed boat in accordance with this invention.

It is not alway necessary to build the whole hull spherically as same as a spherical hull A of FIG. 1 however it is required to build at least the half of the hull under water be hemispherically. It is the objective that the center of gravity be settled as low as possible under the draft.

Figure 2:
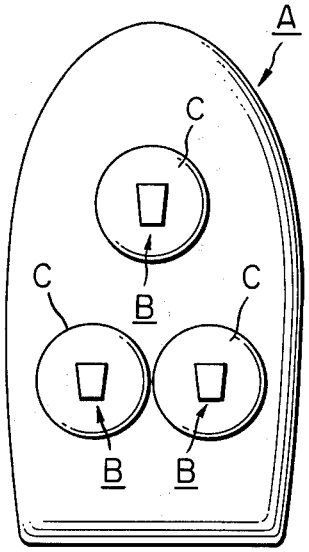
FIG. 2 is a bottom view illustrating another embodiment of said special high-speed boat.
Figure 3:
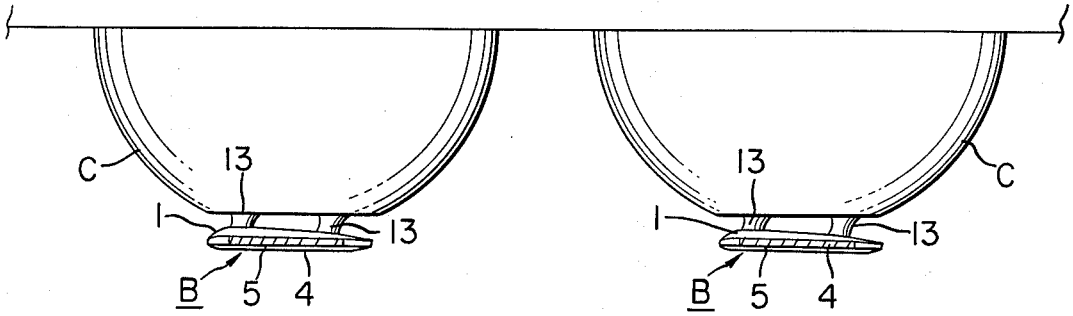
FIG. 3 is a partial side view of FIG. 2.

FIGS. 2 and 3 show another example of a special high-speed boat. The hull A of FIG. 2, is not limited to a certain shape but the hull A is required to have at least three hemispherical bodys C just below the draft. Each of the hemispherical bodys C should be located at each corner to make a triangle form. The hemispherical bodys C may be attached directly to the hull A may be positioned at a distance from the hull A. The advantages of the hull A which satisfies the above conditions are that it has the smallest wave drag including a side wave, a high mechanical strength, the largest capacity against the external area, an easiness for changing direction, a small cost for construction because of its same curvature of front, rear, right and left, a volume of the hull body under the surface of the water which changes largely in relation to the unit measurement of rising when the hull body is raised by buoyancy, and in case of a crash accident, the boat will never sink because the hull body under the water line will never be broken. The advantages of the hull A may be expanded still more by attaching a special propeller unit which will now be described, under said hemispherical bodys C of said hull A.

Figure 4:
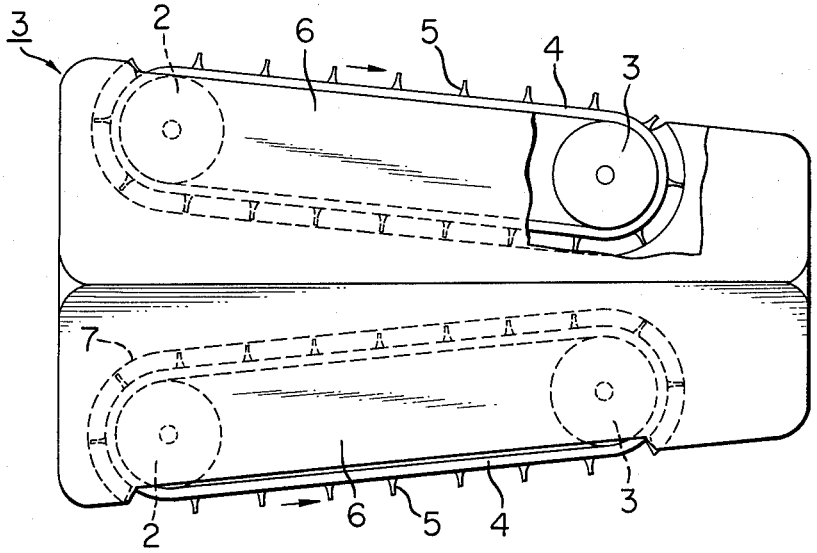
FIG. 4 is a plan view partly in section of a propeller unit in accordance with the present invention.
Figure 6:
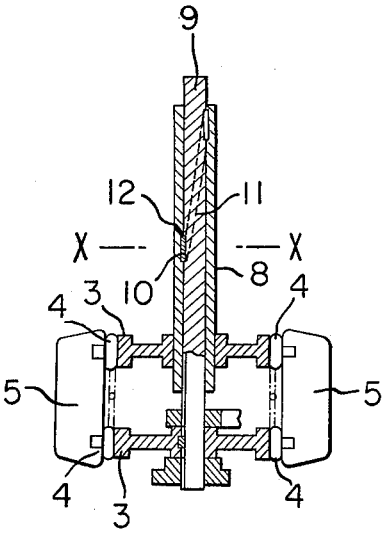
FIG. 6 is a cross-sectional view illustrating an embodiment of a driving wheel according to the present invention.
Figure 7:
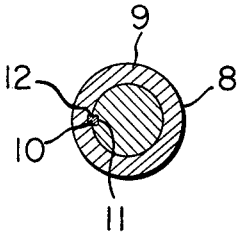
FIG. 7 is a cross-sectional view taken along the line X—X in FIG. 6.

The propeller unit B is attached with legs 13 under each hemispherical body C which is fixed to the hull A. The propeller unit B comprises a hydrofoil or housing 1 which has a space 6 in each side of the propeller unit B as illustrated in FIG. 4. A pair of wheels 2 and 3 are arranged respectively at the front and rear part of said space 6 and an endless belt 4 made for example of chain and including a belt made of metal and other materials with a certain width rotates around the wheels 2 and 3. The pair of right and left belts 4 and 4 have many blades 5 at determined intervals which move around the pair of wheels 2 and 3. The blades 5 are positioned with right angle with respect to the driving direction of the belt 4. One side of the belt 4 moves along the open side of said propeller unit B with a certain number of blades 5 being outside of the propeller unit B and other side of the belts 4 moves inside of the propeller unit B along the inside wall 7 of said space 6. In the above description, the wheel 3 is a driving wheel and arranged on driving shafts 8 and 9 of a double structure as illustrated in FIG. 6. The reason why the double structure of the driving shafts 8 and 9 is used for connection to each wheel of the pair of right and left wheels 3 and 3 is to increase or lower power by controlling the tilting of the blades 5 by the method which rotates the driving shaft 9 with respect to the other driving shaft 8. This operation is performed, for example, by the method in which each shaft of the driving shafts 8 and 9 respectively have oblique key grooves 10 and 11 with key 12 inserted therein, and the driving shaft 9 is driven in its regular direction so that sliding rotation of said driving shaft 9 by the key 12 changes the angle of the blades 5.

Figure 5:
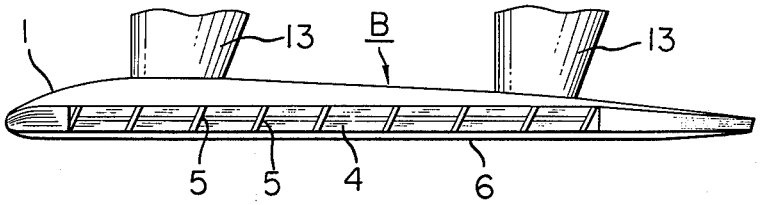
FIG. 5 is a side view of FIG. 4.

The propeller unit B in accordance with the present invention is driven by power transmitted from a driving unit which is located in the hull body. The pair of right and left belts 4 and 4 are driven, then the blades 5 attached to the belt 4 stroke water to move the hull body forward. For moving straight ahead, the right and left belts 4 and 4 are driven in the opposite direction respectively, such that the blades 5 extending out of the both sides of said propeller unit B move to the same direction. For changing direction, one of the belts 4 is stopped or both of them are driven to the same direction. Driving both of said belts 4 to the same direction makes a sharp change in the direction of the boat. Rising power is gained by tilting the blades 5 as illustrated in FIG. 5. The right and left belts 4 and 4 are arranged to make a letter V as illustrated in FIG. 4. The belts 4 and 4 may be arranged parallel with each other or arranged in a narrow front and wide rear propeller unit which is the reverse shape of the propeller unit B which was described above.

The above structures are basical ones of this propeller unit in accordance with the invention, including the following advantages.

That is to say it is recognized from the comparative test of the conventional boat and the boat attached with the propeller unit in accordance with the present invention that the propulsive force of the propeller unit is 2–3 times as large as that of the screw propeller since the impellent efficiency is very high because wave drag is very small and no cavitation occurs. Driving of both right and left belts to the same direction makes it possible to change the direction of the boat without using a rudder as in conventional boats, and also reverse driving of the belts when the boat is moving in the forward direction, makes it possible to stop the boat. These mechanisms worked very well in the experiment.

When gaining rising power by the tilting of the blades, many kinds of resistances against the boat are reduced by a small rising of the boat. Therefore, multiplicative effects of the combination of the spherical hull A and the above described propeller unit B provide a very high acceleration of the boat, which nobody ever imagined so far. It is needless to describe that the advantages already described above are exhibited as it is, and furthermore every one of the performance specification for said propeller unit B is superior to any conventional boats including hydrofoil boats.

What is claimed is:

1. A high-speed boat having at least one propeller unit for driving said boat and said propeller unit comprising:

a. a housing;

b. a plurality of wheel means arranged in spaces within said housing, each said wheel means comprising an upper and lower wheel;

c. at least two endless belt means arranged around said wheel means, each said belt means being in contact with the upper and lower wheel and each said belt means including a plurality of blades extending therefrom such that a portion of said plurality of blades extend outside of said housing wherein the angle of said blades relative to said housing is variable;

d. drive means for rotating at least two of said wheel means, said drive means comprising an inner shaft, an outer shaft and means for rotating said inner and outer shafts, said inner and outer shafts being interconnected by an oblique key inserted in oblique slots therein, said upper wheels being coupled to said outer shaft and said lower wheels being coupled to said inner shaft wherein when said inner and outer shafts are rotated with respect to each other the upper and lower wheels are rotated with respect to each other and thus the upper portion of each of said blades is twisted with respect to the lower portion thereof thereby tilting said blades, said blades extending from said housing and moving through the water thereby propelling said boat.

2. A high speed boat as set forth in claim 1, wherein said boat has a hemispherical hull and said propeller unit is attached to said hull.

3. A high speed boat as set forth in claim 2, wherein a plurality of hemispherical bodies are attached to the hull of said boat, one of said propeller units being attached to each of said hemispherical bodies.

4. A high speed boat as set forth in claim 3, wherein said plurality of hemispherical bodies comprises three said bodies, said bodies being arranged to form a triangle.

* * * * *